United States Patent [19]

Katz et al.

[11] 3,957,958

[45] May 18, 1976

[54] CARBON PURIFICATION PROCESS

[75] Inventors: Seymour Katz, Southfield; Michael M. Shea, Mt. Clemens, both of Mich.

[73] Assignee: General Motors Corporation, Detroit, Mich.

[22] Filed: Jan. 21, 1975

[21] Appl. No.: 542,664

[52] U.S. Cl. ..... 423/461; 423/449

[51] Int. Cl.[2] ..... C10B 57/00

[58] Field of Search ..... 423/448, 449, 461; 75/130 R, 41, 42, 30

[56] References Cited

UNITED STATES PATENTS

| | | | |
|---|---|---|---|
| 1,239,992 | 9/1917 | Weissmann | 423/448 |
| 1,328,845 | 1/1920 | Osgood | 423/448 |

OTHER PUBLICATIONS

Making, Shaping & Treating of Steel, 7th 7th Edition, 1-27-58, pp. 251-252.

*Primary Examiner*—M. J. Andrews
*Attorney, Agent, or Firm*—George A. Grove

[57] ABSTRACT

In accordance with a preferred embodiment of this invention, a low-sulfur, low-ash, graphitic carbon, which is useful in metallurgical and electrical applications, is formed. The first step is dissolving coke or coal in an iron melt containing about 4% silicon, then lowering the temperature of the melt to near the iron-carbon eutectic melting temperature, thereby causing a purified carbon-iron mixture to precipitate and float to the surface. This mixture may be directly used as a metallurgical carbon raiser to control the carbon content of iron melts. The purified carbon may also be separated from the iron by magnetic and/or flotation techniques; further refinement of the graphite may be accomplished by treatment with mineral acids.

5 Claims, 2 Drawing Figures

CARBON PURIFICATION PROCESS

FIELD OF THE INVENTION

This invention relates to a process of purifying relatively low grade carbon sources such as coal, coke or the like.

BACKGROUND OF THE INVENTION

In this time of shortages, high purity carbon may be added to the lengthening list of raw materials which are now in short supply. This situation is readily evident to foundries and other consumers who have watched the price of metallurgical grade carbon, which is an essential ingredient in the production of iron, practically double within the last year. For the consumer who cannot justify the large capital expense of the known carbon purification processes, this situation presents serious economic problems.

In addition to these problems related to metallurgical grade carbon, it is noteworthy that this country depends largely on foreign sources for the high purity natural graphite which is used in many lubrication and electrical applications. This situation may be a source of future problems to several American industries.

Several methods have been developed to purify carbon. For example, U.S. Pat. No. 3,501,272 describes a method which uses mineral acids to remove unwanted impurities, primarily ash. The process described in U.S. Pat. No. 2,657,118 describes a high temperature method using chlorine gas to remove impurities in coke, and U.S. Pat. No. 2,624,698 uses "volatilizable fluorides" at a temperature of at least 250°C. to purify the coke. However, each of these processes, while effective, involves the use of corrosive materials at high temperatures. Extreme care is required in handling these materials and in protecting equipment and the environment against their corrosive effect.

OBJECTS OF THE INVENTION

It is an object of this invention to provide a method of removing both ash and sulfur from coke by first dissolving it in molten iron, and then cooling the molten iron to precipitate a low-ash, low-sulfur, carbon-containing material. The method may be repeated with additional coke using the same iron melt until the sulfur removed from the coke accumulates in the melt to an intolerable level.

It is a further object of this invention to provide a new and improved method of processing low grade carbon sources, such as coal and coke, in molten iron to form carbon raisers for adjusting the carbon content of iron. Carbon raisers produced by this invention have a low sulfur content and consist essentially of carbon, iron and iron oxide.

It is an additional object of this invention to provide a new and improved method of forming graphite suitable for lubrication and electrical applications from low grade carbon sources, such as coal and/or coke, wherein a mixture containing a refined carbon, iron and iron oxide is precipitated from an iron melt. The iron and iron oxide components are then removed by magnetic and/or flotation techniques. A final acid treatment of the carbon may be useful to remove trace impurities such as silicon and the like.

SUMMARY OF THE INVENTION

In accordance with a preferred embodiment of this invention, finely divided coke particles, having a largest dimension of about 1/10 inch, are added to an iron melt, preferably by being injected below the surface. The melt temperature should be as high as the economics of the refractory life will permit, but not to exceed the boiling point of the melt which is near 3,000° C. Sufficient coke is introduced to bring the carbon content of the melt to a preferred range of from about 4% to about 6% by weight. It is also preferred that the iron melt contain about 4% by weight of silicon or similar alloy to increase the yield of the process. Graphitizers may also be present including, small amounts of titanium (i.e., less than about ¼% by weight), aluminum, copper, and nickel. However, the melt should not include carbide formers which would reduce the efficiency of the subject process. This process relies in part on the instability of cementite ($Fe_3C$) and other carbides at molten iron temperatures. Nothing should be added to stabilize such carbides. These undesirable carbide-promoting constituents include manganese, molybdenum, tungsten, tantalum, vanadium, niobium, chromium, bismuth and titanium above a concentration of about ¼% by weight. At high melt concentrations sulfur may also catalyze the formation of carbides. Therefore, the sulfur level should be controlled by the use of a desulfurization agent.

Much of the carbon will dissolve in the iron melt. However, the ash content of the coke will not dissolve and an insoluble residue will float to the surface and form a slag which is then removed; this slag may also contain undissolved carbon. The melt temperature is then lowered to about the melt eutectic temperature. As the melt cools, carbon having a low sulfur content and little or no ash will precipitate and float to the surface in combination with a mixture of iron and iron oxides.

This iron-carbon slag-like mixture is removed from the melt surface and may be directly used as a metallurgical carbon raiser in the production of iron, or subjected to magnetic and/or flotation techniques to separate the carbon from the iron and iron oxides. Finally, any residual iron or trace impurities may be removed by treating the carbon with strong mineral acids. These processes will produce a high purity, flake graphite suitable for use in lubrication and electrical applications.

At this point, the temperature of the iron melt is then raised to a suitable dissolution temperature in preparation for the next cycle. During this heating process it will be necessary, from time to time, to add a desulfurizing agent to maintain a sulfur content in the melt of less than about ½% by weight. Suitable desulfurization agents, including calcium carbide and calcium oxide and the like, react with the sulfur and form an insoluble sulfur-containing slag which is removed from the melt.

The advantages of the subject method will be more easily understood in view of a detailed description thereof to include specific examples thereof.

This description will make reference to the drawings, in which:

FIG. 1 depicts a recirculating annular vessel useful in the continuous operation of the subject carbon refinement process; and FIG. 2 is a schematic cross-sectional side view of a two-vessel apparatus for the continuous operation of the subject carbon refinement process.

DETAILED DESCRIPTION OF THE INVENTION

Figure 1:
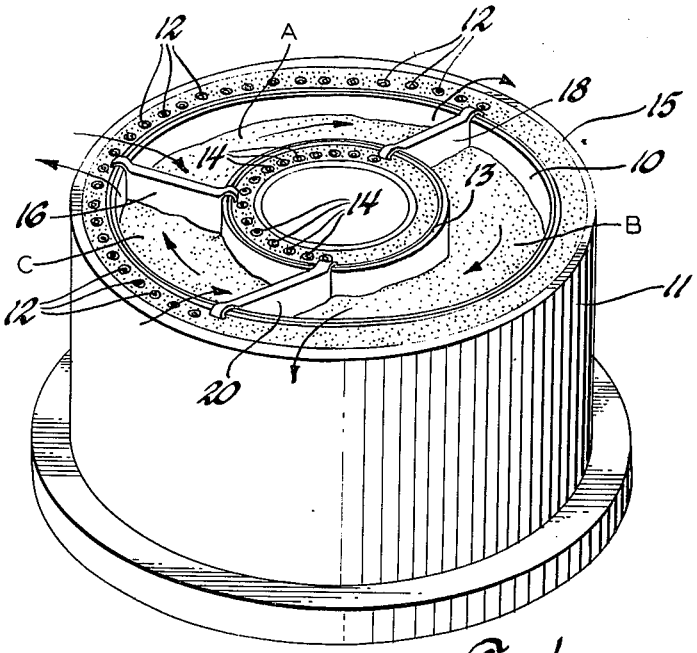

In accordance with our invention it is possible to produce a carbon-containing material which is useful in metallurgical applications. The precipitate from the iron melt typically contains carbon, iron and iron oxide. The ash and sulfur content of the carbon is markedly reduced. The refined carbon-containing product is particularly useful as a carbon raiser for increasing, under controlled conditions, the carbon content of iron and steel. The low sulfur content makes this material particuarly desirable for these applications.

In addition, subsequent separation techniques may be used to remove the iron and iron oxide components and trace impurities, such as silicon, and thereby produce high purity graphite which is useful in lubrication and electrical applications.

The basic principles used in the practice of this invention are: (1) that the solubility of carbon in molten iron has a positive temperature coefficient; and (2) that sulfur has a higher solubility limit in molten iron than does carbon. Therefore, as the iron solution is cooled the carbon precipitates and the sulfur does not. Thus, a relatively sulfur-free carbon-containing material is produced.

Theoretically, it should be possible to repeat this process with a given melt until the sulfur concentration reaches its solubility limit in iron which is in excess of 20% by weight. However, it has been found that it is difficult to produce a low-sulfur, carbon-containing precipitate from an iron melt having a sulfur content much above about ½% by weight.

In considering this problem, it should be noted that the precipitate contains not only carbon but also large quantities of iron and iron oxides. These additional components do not present any direct problems in metallurgical applications as the entire precipitate may be used as a carbon raiser. However, it appears that even though the carbon component of the precipitate is relatively free of sulfur, the iron or iron oxide component for some reason has a much higher sulfur content. For example, it has been found that at melt sulfur levels greater than about ½% by weight, the sulfur level in the carbon-iron precipitate is too high for the precipitate to be used as a carbon raiser.

Because the sulfur is primarily in the iron-iron oxide component, it is possible by conventional separation techniques to greatly increase the purity of the precipitate by removing the iron-iron oxide mixtures. Furthermore, it is believed that the sulfur may be partitioned in the iron oxide component of the precipitate and, therefore, it is apparently possible to significantly increase the efficiency of the system and increase the maximum allowable sulfur concentration in the melt by preventing the formation of iron oxide. This could be done by maintaining a nonoxidizing atmosphere over the melt. Suitable inert gases are argon, krypton, neon, helium, nitrogen and the like. A vacuum would also be suitable. Therefore, this is to be considered part of a preferred embodiment of the subject invention.

Economically it would be advantageous to use the entire precipitate which contains iron, oxides of iron and carbon as a carbon raiser. Therefore, in a preferred practice of this invention the iron melt is periodically desulfurized by the addition of a suitable desulfurizing agent, such as calcium carbide or calcium oxide and the like, to maintain a sulfur level in the melt of less than about ½% by weight. These materials react with the sulfur to form a calcium sulfide which is insoluble and may be removed from the surface of the melt as a slag.

It is also to be considered within the scope of this invention to further reduce the sulfur content of the separated precipitate by applying conventional magnetic and flotation techniques. These methods separate the initial precipitate into its carbon and iron components, and thereby produce a relatively pure graphitic product.

In accordance with a preferred practice of this invention, the iron melt contains silicon at a level of from 3½% to 4½% by weight. The presence of silicon in the iron melt significantly increases the yield of carbon precipitated during a given decrease in temperature. For example, the carbon content (% by weight) of an iron melt initially containing 4.5% carbon and 4% silicon decreases 0.00375% per degree Fahrenheit decrease in temperature. Comparatively, the carbon content of an iron melt initially containing 5.5% carbon and no silicon decreases only 0.00185% carbon per degree Fahrenheit decrease in temperature. These figures were calculated from equilibrium phase diagrams.

In general, other elements which do not interfere with the graphite precipitation and formation process may also be present in the iron melt. More specifically, it is preferred that graphitizers which prevent the formation of carbides, and thereby increase the efficiency of the subject process, be present in concentrations up to about 4% by weight. Examples of these materials include silicon, aluminum, copper, nickel and even sulfur at concentrations below about ½%.

In addition, there are a group of alloying elements known to be carbide formers which specifically interfere with the precipitation of graphite. These materials are to be considered beyond the scope of this invention because their presence at a concentration of above about 1/5% by weight may significantly decrease the efficiency of the subject process. Examples of these materials include manganese, molybdenum, tungsten, tantalum, vanadium, niobium, chromium, bismuth, titanium above about ¼% by weight.

To provide a better understanding of the effect of the alloying elements in the iron melt, the following thermodynamic concepts are presented.

The thermodynamic activity of carbon has a great influence on its solubility in iron melts and its tendency to chemically react with other compounds. Furthermore, it is well known that other alloying elements in an iron-carbon system can affect the activity of carbon and thereby solubility. In general, these alloying elements have been placed in one of two classes: the first being those materials which decrease the activity of carbon and thereby reduce its tendency to precipitate from solution, and the second being those elements which tend to increase the activity of carbon causing it to precipitate from the solution and/or react with other compounds in the atmosphere or in the melt.

Generally, elements of the first group are called "carbide promoters" and, as mentioned above, include such alloying elements as titanium and chromium, vanadium, cerium and bismuth. On the other hand, elements of the second group prevent carbide formation and are often called "graphitizers"; this group, as mentioned above, may include silicon, aluminum, copper and nickel, and possibly sulfur at very low concentrations. In view of this, it is to be understood that the efficiency of the basic process is directly affected by the presence of either type of alloy. More specifically, it would be expected that if a graphitizer were added, the efficiency of the process would be increased and that, on the other hand, if a carbide former were added, perhaps the efficiency would be decreased.

A more important, but perhaps not unrelated, effect of alloying elements on the efficiency of the subject process is their impact on the solubilities of iron and carbon as reflected in changes in the iron-carbon equilibrium phase diagram. For example, silicon has the effect of reducing the carbon concentration of the eutectic composition, as seen in the following diagram. A natural consequence of this change is a reduction in the slope of the liquidus line between the eutectic point and that point at which the liquidus line reaches a carbon concentration of 6.6% by weight, the composition of iron carbide ($Fe_3C$). From the iron-carbon diagram it is possible to determine how much carbon will be precipitated from a melt solution by following the liquidus line from the dissolution temperature to the final precipitation temperature and determining the change in percent carbon. By this analysis, it is apparent that for a given temperature drop between the dissolution temperature and the precipitation temperature, the presence of silicon will increase the yield of carbon. (See the following diagram.)

thoroughly understood and the scope of this invention is not to be limited by this theory.

In the practice of this invention rare earth elements and magnesium are preferably avoided in concentrations above 1% by weight as the graphite produced when these elements are present in the iron melt is spheroidal and wetted by the iron and is, therefore, extremely difficult to separate from the iron melt. Higher sulfur concentrations also create a spherical graphite. However, the wetting problems, such as those generated by the rare earth and magnesium alloys, are not evident at higher sulfur concentrations.

EXAMPLE 1

An initial charge of 4 pounds of SAE 1010 steel and 0.24 pound of coke, containing 0.8% by weight sulfur, was placed in an Ajax Magnethermic, 3,000 cycle per second, laboratory induction furnace having a capacity of 100 pounds and a power rating of 100 kilowatts. The crucible refractory was zircon ($ZrSiO_4$). SAE 1010 steels are specified to contain, by weight, from 0.08% to 0.13% carbon, from 0.30% to 0.60% manganese, a maximum of 0.04% phosphorus, a maximum of 0.05% sulfur, and the balance iron.

The steel was melted and the charge was further heated to 1,675° C. to dissolve the carbon portion of the coke. After 15 minutes undissolved coke and ash were removed from the melt surface, and the furnace

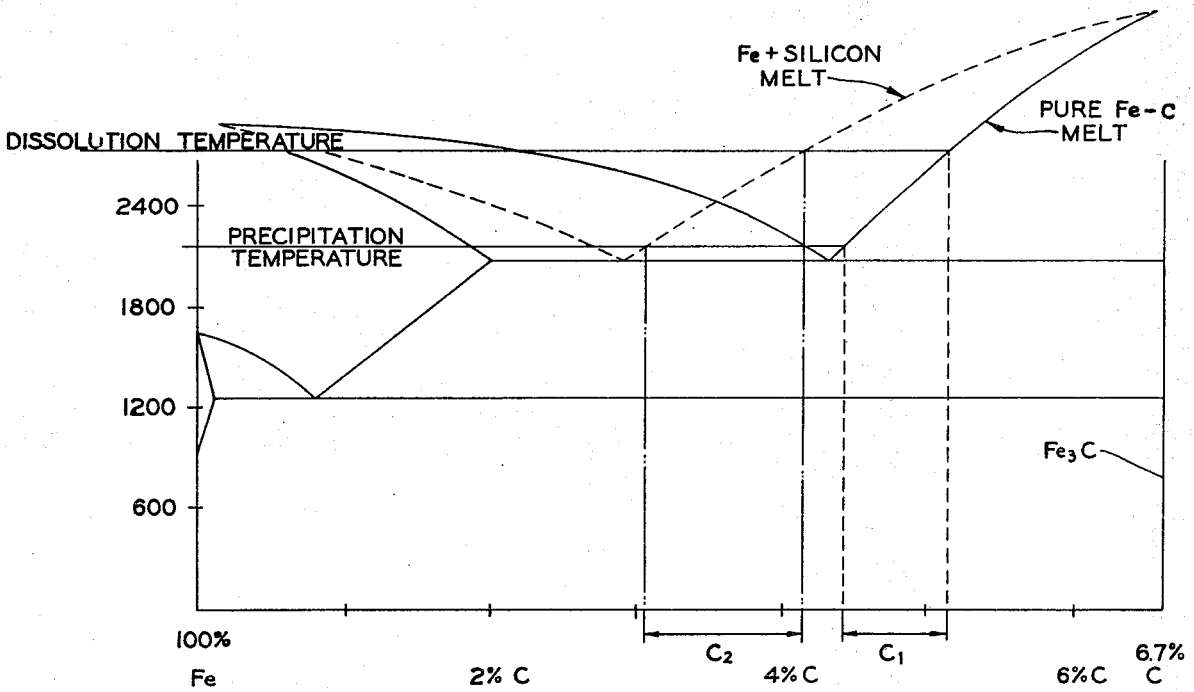

NOTE: $C_1$ is proportional to the amount of carbon which may be recovered from a pure iron melt; $C_2$ represents the amount which may be recovered from an iron melt containing an alloy such as silicon. From this it is evident that alloys which decrease the slope of the liquidus line and lowers the carbon concentration of the eutectic composition can significantly increase the yield of the subject process.

In general, it is to be understood that the effect of various alloys on the solubility of carbon in iron as reflected in the phase diagrams may be related to the tendency of that specific alloy to promote or inhibit the formation of carbide. However, this correlation is not power was turned off. A sample of the melt was analyzed by gravimetric combustion analysis on a Leco Carbon Analyzer. The carbon content was 5.27% by weight. The manganese content was 0.4% and the sulfur content was 0.04%.

As the melt cooled, a carbon-containing precipitate formed on the surface. Samples were removed both manually with a ceramic scoop and also by vacuum until the melt temperature reached 1,290° C. and the surface began to solidify. The furnace power was then turned on and the cycle was repeated. titration It was observed that the precipitate recovered from the melt contained a substantial amount of iron. The precipitate was comminuted and spread over a surface. A magnet was passed over the particles to remove the iron and iron oxide. The nonmagnetic portion was immersed in water. The portion floating to the surface was removed, rinsed with alcohol and retained as a purified carbon product. It was found to contain 60.1% by weight carbon and 0.03% by weight sulfur, and the balance iron and iron oxide. This was measured by a combustion iodimetric titration technique. Thus, the sulfur content of the coke was reduced from 0.8% by weight to 0.03% by weight, and the product is suitable for use as a carbon raiser. This is a significant improvement over commercially available carbon raisers which typically have from 0.25% to 0.30% by weight sulfur.

Magnetic and flotation separation processes are described in more detail in several texts, including "Principles of Mineral Dressing" by A. M. Gaudin, McGraw Hill, New York, New York (1939) in Chapters 15 and 18, respectively. It is expected that the more sophisticated techniques described in the aforementioned text would be even more effective than the manual procedures of Example 1 in refining the precipitate produced in accordance with this invention.

EXAMPLE 2

In accordance with the precipitation procedures outlined in Example 1, five additional runs were made. The melt compositions before precipitation, and processed precipitate compositions are itemized in Table I. It is to be noted that the precipitate from run No. 1 was not floated but only magnetically separated, and that the final melt run No. 6 did not yield a precipitate but did spark. Apparently, the high sulfur content in combination with the silicon raised the reactivity of the graphite to such a level that as it precipitated, it immediately oxidized, thereby causing the sparks.

Table I

| Melt and Precipitate Compositions | | | | | | | |
|---|---|---|---|---|---|---|---|
| | Melt Chemistry, w/o* | | | | Precipitate Composition, w/o** | | |
| Run No. | C | Mn | Si | S | C | S | Si |
| 1 | 4.80 | 0.40 | — | 0.52 | 41.1 Not Floated | 0.83 | — |
| 2 | 4.20 | 0.40 | — | 1.1 | 51.1 | 3.4 | — |
| 3 | 4.71 | 0.40 | — | 1.69 | 54.9 | 5.9 | — |
| 4 | 3.78 | 0.40 | 4.03 | 0.04 | 61.0 | 0.04 | 1.97 |
| 5 | 3.73 | 0.49 | 3.07 | 0.06 | 66.1 | 0.04 | 1.42 |
| 6 | 4.68 | 0.40 | 4.00 | 0.98 | No Precipitate | | |

*The balance of each melt was iron.
**The balance of each precipitate was a mixture of iron and iron oxide.

From this data several points regarding the subject process become evident. First, the sulfur level in the melt must be maintained near or below about ½% by weight to insure a sulfur level in the precipitate below about ½% by weight. Secondly, this data illustrates that the carbon melt may, in general, contain other alloying elements and still properly function. Finally, the data in the six runs tends to indicate that as the levels of silicon and sulfur increase to about 4% and 1% by weight, respectively, the carbon which precipitates is apparently oxidized so rapidly that there is no recoverable precipitate.

EXAMPLE 3

In accordance with the precipitation procuedures outlined in procedures 1, and using the same carbon-containing material, an additional run was made wherein the iron melt contained no constituents other than carbon and manganese, above about ½% by weight, and the manganese concentration was considerably less than in the previous examples. The same source of carbon, having 0.8% by weight sulfur, was also used. The melt and precipitate compositions are listed below. Some separation of the carbon and the iron components of the precipitate was accomplished by magnetic and flotation techniques.

| Melt Composition Before Precipitation (% By Weight) | | | Precipitate Composition (% By Weight) | | |
|---|---|---|---|---|---|
| C | S | Mn | C | S | Mn |
| 5.04 | 0.016 | 0.16 | 76.7% | 0.02% | 0.3 |

NOTE:
The balance of each composition is iron and/or iron oxide.

This run was made to demonstrate that the basic process involved in this invention is not dependent upon, and should not be limited to, the presence of any particular alloy in the melt composition. As in Example 1, there was a marked reduction in sulfur content. The coke originally contained 0.8% by weight and the carbon-iron product contained only 0.02%.

The yield of the subject method, as measured by the ratio of the amount of purified carbon extracted to the amount of carbon-containing material charged into the system, will depend on many parameters, including: (1) the purity of the input material; (2) the dissolution time and temperature; (3) the ratio of melt surface area to melt volume; and the like. In general, the subject process will approach, as a limit, the concentrations predicted by the equilibrium phase diagram as the rates of temperature changes are reduced.

The above description of the subject invention has employed a batch mode embodiment to clearly point out and define our invention. It is believed that many practitioners of our invention wil find that the batch mode best fits their purposes. However it is to be recognized that the subject invention may also be practiced in various continuous modes. The following discussion describes and defines two of these continuous modes.

In accordance with the practice of this invention, a circulating closed loop of molten iron held in an annular vessel 10, rotatably mounted within a stationary annular fixture 11, having an inner shell 13 and an outer shell 15, may be used (see FIG. 1). In the operation of this embodiment, the surface of the melt is divided by stationary slag dams into three regions, labeled A, B and C. These slag dams are mounted on the stationary fixture 11 and are held in a fixed position relative to each other, and relative to the temperatures and temperature gradients in the iron melt. Mounted in the outer shell 15 of the annular fixture 11 is an external bank of heaters 12. Similarly mounted in the inner shell 13 of fixture 11 is an internal bank of heaters 14. These two banks of heaters are positioned adjacent to melt regions A and C. The annular vessel 10 is slowly rotated by means not shown, under the stationary slag dams 16, 18 and 20. In addition to the stationary heater banks 12 and 14, there is another heating unit (not shown) which is used during start-up to initially melt the iron and which may be used to maintan a minimum overall melt temperature.

The iron melt in region A should be held at a temperature of 1,675° C. or higher. Ideally, the melt temperature should be as high as possible as this would increase the quantity of carbon that will dissolve in the melt. The upper temperature limit in this region would be the economic limit imposed by the refractory lining of the annular vessel 10 and the capabilities of heating elements and their controls. A suitable carbon-containing material is continuously injected below the melt surface of region A at a point closest to region C. As the vessel 10 rotates, the charged melt moves through region A towards region B and the carbon is mostly dissolved. The ash constituent of the charged material will be insoluble in the molten iron and float to the surface as an ash-containing slag. This slag will be removed along with any other undissolved material at the slag dam 18 which separates region A and region B. As the melt passes under slag dam 18 and leaves the influence of the heater banks 12 and 14, it begins to cool. Because of the positive temperature coefficient of the solubility of carbon in the iron melt, the solution becomes saturated and the carbon begins to precipitate and float to the surface. Cooling means may be necessary to achieve an economically attractive yield.

The precipitated carbon will form a surface layer in combination with some iron and iron oxide materials. This layer is then removed at the slag dam 20 which separates region B from region C. Ideally, the temperature at this point should be near the iron-carbon eutectic temperature of the melt. However, any significant drop in temperature across region B will cause carbon to precipitate and this carbon will be a relatively sulfur-free material. However, whether the temperature drop is from, for example, 2,100° C. to 1,800°C. or from 1,600° C. to 1,300° C. may affect the amount of iron and/or iron oxide in the precipitate. The degree to which the melt is cooled will depend on the heat transfer capabilities of the basin, the volume of the basin and the distance between slag dams 18 and 20.

At this point it should be noted that the carboncontaining precipitate may contain as much iron and iron-containing components as it does carbon. Furthermore, experiments have shown that as the sulfur content of the iron melt exceeds about ½% by weight the sulfur content of the precipitate rises quickly. Apparently, this is due to some partitioning phenomenon, and additional experimental work has indicated that the iron components in the precipitate are comparatively heavily loaded with sulfur. Therefore, it is possible to use conventional magnetic or flotation separation techniques to separate the carbon component from the iron component in the precipitate and thus form a relatively sulfur-free carbon-containing product. For example, in one experiment, (example number 1), when the sulfur level in the melt was 0.04% by weight and the sulfur in the coke was at 0.08%, the sulfur concentration in the precipitate was 0.03% by weight. However, after this precipitate was subjected to magnetic and flotation separation techniques and a hydrochloric acid treatment to remove a large portion of the iron-containing component and trace impurities, such as silicon and the like, the precipitate contained 90% carbon with only 0.07 % weight percent sulfur. This suggests that a subsequent separation of iron from the precipitate, i.e., by magnetic and/or flotation techniques, will extend the permissible sulfur content of the melt before desulfurization is required, and also significantly improve the purity of the carbon product. By the addition of these steps, possible in combination with a mineral acid treatment to remove traces of iron and silicon, a graphite suitable for lubrication and electrical applications may be produced.

In region C at the slag dam 20 which separates region B from region C, a desulfurization agent, such as calcium carbide or calcium oxide, is periodically added to the cooled melt. These agents will chemically combine with the sulfur and form an insoluble material which floats to the surface as a slag. This is removed at the slag dam 16 that separates region C from region A. As the iron melt enters region C and the influence of heater banks 12 and 14, heat is added to raise the temperature of the melt to the level of region A. The size of the vessel 10, the heating element capacity, and the distance between slag dams 20 and 16 should be selected so that the temperature of a specific melt portion has reached or is near the dissolution temperature as the portion enters region A where the cycle begins again.

Figure 2:
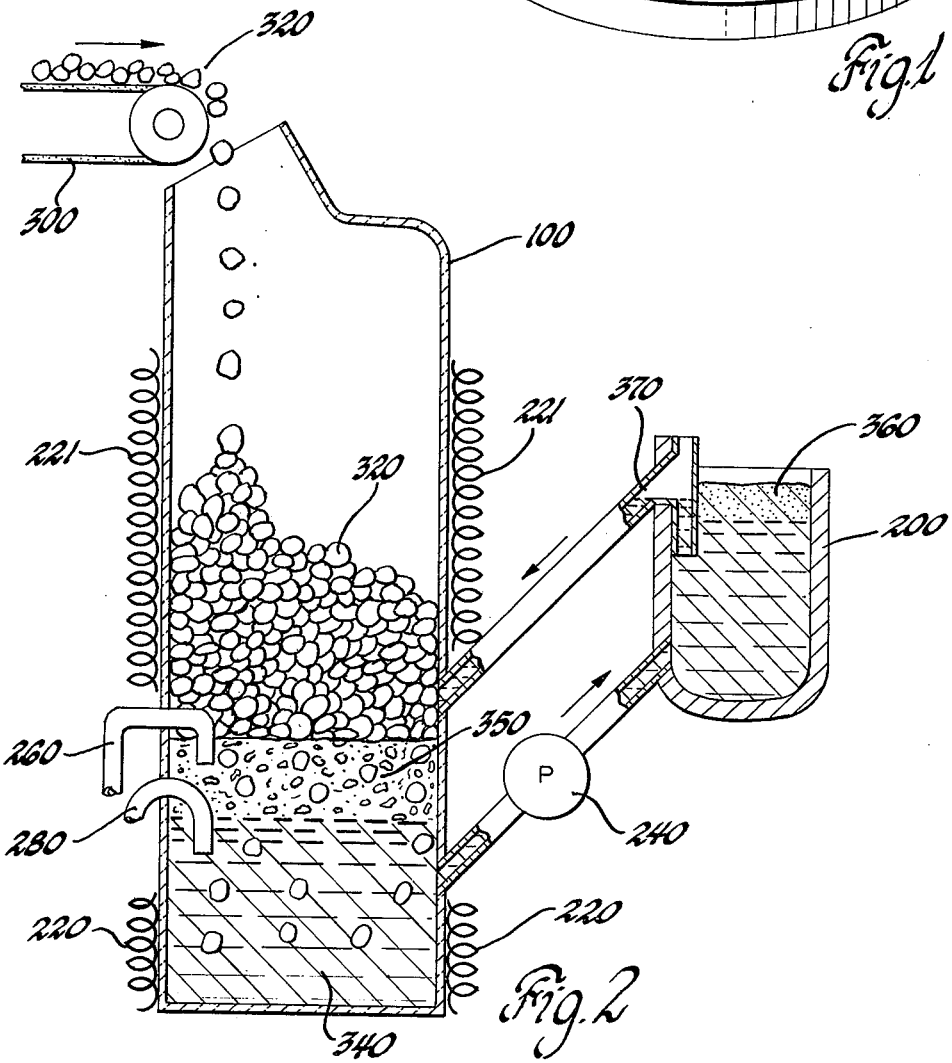

In accordance with the practice of another continuous mode of this invention, a two-vessel apparatus as shown in FIG. 2 may be employed. In this mode the charge 320 consisting of coke or other carbon-containing material and a desulfurization agent, such as calcium oxide or calcium carbide, are charged into the open upper end of a tall, generally cylindrical melting vessel 100 from a conveyor belt 300. At the bottom of melting vessel 100 is an iron melt 340 heated by elements 220 to a temperature as high as the refractory liner will economically permit. On top of this melt is a slag 350 containing ash and sulfur compounds, and on top of this slag would be the newly charged material. The slag 350 and the newly charged material 320 are heated by elements 221. As shown in FIG. 2, means 260 and 280 would be employed to control the level of the slag 350 and that of the iron melt 340.

The carbon-containing melt 340 is pumped through a conduit to a precipitating vessel 200 by an electromagnetic pump 240. Once in this vessel 200, the melt 340 is cooled to a point preferably near the iron-carbon eutectic temperature. This, of course, would cause the carbon to precipitate and float to the surface forming a recoverable layer 360, typically in combination with iron and iron-containing components. This precipitate would then be removed and optionally treated with the magnetic, flotation and/or acid separation techniques to produce a purified carbon product. The carbon-poor iron melt 370 from the top of the precipitating vessel 200 would then be recycled back into the charging vessel 100, thus completing a closed loop process.

While our invention has been described in terms of certain specific embodiments, it will be appreciated that other forms thereof could readily be adapted by one skilled in the art. Therefore, the scope of our invention is not to be limited to the specific embodiments disclosed.

What is claimed is:

1. A method of forming a low-sulfur carbon raiser comprising:

a. dissolving a sulfur-containing carbonaceous material selected from the group consisting of coal and coke in molten iron in such proportions to provide a carbon concentration in said melt in the range of from about 3½% to about 6½% by weight;

b. removing any undissolved material;

c. cooling said melt to precipitate said carbon which floats to the surface forming a recoverable constituent which may also contain iron;

d. removing said carbon-containing constituent from the surface of said melt;

e. repeating steps (a) through (d) using said iron melt; and f. maintaining a sulfur concentration in said iron melt below about ½% by weight by periodically precipitating sulfur from the melt with a desulfurization agent and removing the precipitate from the melt.

2. A continuous method of forming a low-ash, lowsulfur, carbon-containing material, said method comprising:

a. melting iron in a closed loop vessel having three thermal regions: 1. a carbon dissolution region wherein a near constant iron melt temperature in the range of from about 1,400° C. to about 2,800° C. is maintained, 2. a carbon precipitation region wherein the temperature of said melt is lowered from that of said dissolution region and a low-sulfur, low-ash, carbon-containing material recovered, and 3. a desulfurization and reheating region where sulfur is removed and said melt is reheated to the temperature of said dissolution region;

b. moving said melt through said thermal regions in a direction so that an increment of said melt in said dissolution region will pass to said precipitation region, then to said desulfurization and reheating region, and then to return to said dissolution region;

c. charging said carbon-containing material into said dissolution region;

d. removing an ash-containing undissolved slag from said dissolution region;

e. removing said carbon-containing constituent which precipitates from said melt in said precipitation region;

f. charging a desulfurization agent into said desulfurization and reheating region in concentrations which will maintain a sulfur level in the melt below a level of about ½% by weight;

g. removing said sulfur-containing slag from said desulfurization and reheating region; and h. repeating (b) through (g).

3. A continuous method of forming a low-ash, lowsulfur, carbon-containing material comprising the steps of:

a. charging a carbon-containing substance selected from the group consisting of coke and coal into an iron melt, and thereby dissolving the carbon in such proportions to maintain a carbon concentration in said melt in the range of about 3½% to about 6½% by weight in a charging vessel;

b. pumping said charged melt to a precipitation vessel;

c. cooling said melt in said precipitation vessel to precipitate a carbon-containing recoverable constituent;

d. returning said cooled melt to said charging vessel for recycling and reheating;

e. maintaining a sulfur level in said melt below about ½% by weight by periodically charging a desulfurization agent into said charging vessel;

f. removing the slag formed on the surface of said melt in said charging vessel; and g. repeating (a) through (f).

4. A method of forming a low-sulfur carbon comprising:

a. dissolving a sulfur-containing carbonaceous material, selected from the group consisting of coke and coal in molten iron containing from about 3% to about 5% by weight silicon, in such proportions to provide a carbon concentration in said melt in a range of from about 3% to about 6½% by weight, said melt being protected by a nonoxidizing environment which reduces the formation of oxides on the surface of the melt and in said carbon;

b. removing any undissolved material from the surface of the melt;

c. cooling said protected melt to precipitate a low-sulfur carbon which floats to the surface;

d. removing said low-sulfur carbon from the surface of said melt;

e. repeating steps (a) through (d) using said iron melt; and f. desulfurizing said iron melt as required to maintain the accumulation of sulfur below a desired level.

5. A method of forming a low-sulfur carbon raiser comprising:

a. dissolving a sulfur-containing carbonaceous material selected from the group consisting of coal and coke in molten iron, containing an element which alters the iron-carbon equilibrium phase diagram by decreasing the slope of the liquidus line above the eutectic composition and shifting the eutectic composition to a lower carbon concentration, said element being present in a concentration within the range from about 2½% to about 4½%, in such proportions to provide a carbon concentration in said melt in the range of from about 3% to about 6½% by weight, said melt being protected by a nonoxidizing atmosphere which reduces the formation of oxide in the surface of the melt and in said carbon-containing material;

b. removing any undissolved material from the surface of the melt;

c. cooling said protected melt to precipitate said carbon which floats to the surface forming a low-sulfur recoverable carbon raiser;

d. removing said low-sulfur carbon raiser from the surface of said melt;

e. repeating steps (a) through (d) using said iron melt; and f. desulfurizing said iron melt as required to maintain the accumulation of sulfur below a desired level.

* * * * *

UNITED STATES PATENT AND TRADEMARK OFFICE

CERTIFICATE OF CORRECTION

PATENT NO. : 3,957,958

DATED : May 18, 1976

INVENTOR(S) : Seymour Katz and Michael M. Shea

It is certified that error appears in the above-identified patent and that said Letters Patent are hereby corrected as shown below:

Title page, "Other Publications", "7th 7th Edition" should read -- 7th Edition --.
Column 7, line 6, delete "titration".
Column 8, line 46, "wil" should read -- will --.
Column 9, lines 46 and 47, "carboncontaining" should read -- carbon-containing --;
Column 9, line 62, "0.08%" should read -- 0.8% --.
Column 10, line 1, "0.07%" should read -- 0.007% --.

Signed and Sealed this

Tenth Day of August 1976

[SEAL]

*Attest:*

RUTH C. MASON
*Attesting Officer*

C. MARSHALL DANN
*Commissioner of Patents and Trademarks*